US011441349B2

(12) United States Patent
Dixon et al.

(10) Patent No.: US 11,441,349 B2
(45) Date of Patent: Sep. 13, 2022

(54) READY TO INSTALL DOOR SYSTEM

(71) Applicant: Larson Manufacturing Company of South Dakota, Inc., Brookings, SD (US)

(72) Inventors: Alan M. Dixon, Brookings, SD (US); Lucas M. Hemmen, White, SD (US); Michael W. Kondratuk, Brookings, SD (US); Kelly D. Nordgaard, Gary, SD (US); Jammey A. Rawden, Volga, SD (US)

(73) Assignee: Larson Manufacturing Company of South Dakota, LLC, Brookings, SD (US)

( * ) Notice: Subject to any disclaimer, the term of this patent is extended or adjusted under 35 U.S.C. 154(b) by 226 days.

(21) Appl. No.: 16/555,654

(22) Filed: Aug. 29, 2019

(65) Prior Publication Data

US 2022/0003035 A1 Jan. 6, 2022

Related U.S. Application Data

(60) Provisional application No. 62/724,327, filed on Aug. 29, 2018.

(51) Int. Cl.

| | |
|---|---|
| ***E06B 1/04*** | (2006.01) |
| ***E06B 1/60*** | (2006.01) |
| ***E06B 1/52*** | (2006.01) |
| ***E05F 3/22*** | (2006.01) |
| *E06B 5/00* | (2006.01) |

(52) U.S. Cl.

CPC ..... *E06B 1/6076* (2013.01); *E05F 3/22* (2013.01); *E06B 1/52* (2013.01); *E05F 2003/228* (2013.01); *E05Y 2201/624* (2013.01); *E05Y 2900/132* (2013.01); *E06B 5/003* (2013.01)

(58) Field of Classification Search

CPC ..... E04F 21/0023; E04F 21/0007; E04F 21/0015; E06B 5/003; E06B 3/70; E06B 1/52; E06B 3/36; E06B 5/00; E06B 3/9682; E06B 1/6015; E06B 2003/7074; E06B 2003/7049; E06B 1/34; E06B 1/347; E06B 2003/7059; E06B 2003/7046; E06B 3/72; E06B 3/16; E06B 3/5821

USPC ..... 49/324, 346, 381, 399, 380, 382, 504, 49/503; 292/143; 52/213, 656.2, 656.4; 16/65, 71, DIG. 7

See application file for complete search history.

(56) References Cited

U.S. PATENT DOCUMENTS

| | | | | |
|---|---|---|---|---|
| 4,106,238 A * | 8/1978 | Bonello | ..... | E05D 7/02 16/243 |
| 4,631,866 A * | 12/1986 | Otto | ..... | E06B 1/32 292/341.19 |
| 5,327,684 A * | 7/1994 | Herbst | ..... | E05D 7/02 16/249 |
| 6,389,644 B1 * | 5/2002 | Russo | ..... | E05D 5/06 16/254 |

(Continued)

*Primary Examiner* — Chi Q Nguyen

(74) *Attorney, Agent, or Firm* — Kagan Binder, PLLC

(57) ABSTRACT

Ready-to-install door systems comprising, prior to installation, a door, a hinge-side z-bar, a drip cap, and a latch-side z-bar, all connected. In addition, the system may comprise door closer hardware attached to the door and either the drip cap or the hinge-side z-bar; an installation notch; or screw holders. Screw holders are also provided. Methods of installing the present door systems are also provided.

22 Claims, 16 Drawing Sheets

(56) References Cited

U.S. PATENT DOCUMENTS

| | | | | |
|---|---|---|---|---|
| 6,688,063 | B1 * | 2/2004 | Lee | E05B 9/08 49/501 |
| 7,661,226 | B2 * | 2/2010 | Kibbel | E06B 1/526 49/382 |
| 8,857,105 | B2 * | 10/2014 | Hemping | E06B 3/36 49/396 |
| 8,915,031 | B2 * | 12/2014 | Dixon | E06B 1/6053 52/204.1 |
| 9,624,722 | B2 * | 4/2017 | Hummel | E06B 9/58 |
| 11,008,795 | B1 * | 5/2021 | Dixon | E06B 3/40 |
| 11,035,169 | B1 * | 6/2021 | Wermers | E06B 1/6015 |
| 2015/0361718 | A1 * | 12/2015 | Hummel | E06B 9/52 160/189 |
| 2021/0270046 | A1 * | 9/2021 | Wermers | E06B 5/003 |

* cited by examiner

READY TO INSTALL DOOR SYSTEM

CROSS-REFERENCE TO RELATED APPLICATION

This application claims priority to U.S. Provisional Patent Application No. 62/724,327, filed Aug. 29, 2018, entitled "READY TO INSTALL DOOR SYSTEM," of which is incorporated by reference herein, in the entirety and for all purposes.

FIELD OF THE DISCLOSURE

This disclosure relates to a quick-install door system, such as a storm door, and components thereof.

SUMMARY OF THE DISCLOSURE

Briefly, the present disclosure provides A ready-to-install door system comprising, prior to installation a door, which is rotatably attached on a hinge-side edge to a hinge-side z-bar, which is attached at a top end to a drip cap, which is attached to a top end of a latch-side z-bar; where the system comprises door closer hardware attached to the door and either the drip cap or the hinge-side z-bar.

In one aspect, the present disclosure provide a ready-to-install door system comprising, prior to installation: a) a door, which is rotatably attached on a hinge-side edge to b) a hinge-side z-bar, which is permanently attached at a top end to c) a drip cap, which is permanently attached to a top end of d) a latch-side z-bar; where the system comprises door closer hardware, the door closer hardware comprising a closer arm rotatably attached to a slider which is slideably attached to the drip cap. In some embodiments, the door comprises door closer hardware contained within the thickness of the door.

In another aspect, the present disclosure provides a ready-to-install door system comprising, prior to installation: a) a door, which is rotatably attached on a hinge-side edge to b) a hinge-side z-bar, which is permanently attached at a top end to c) a drip cap, which is permanently attached to a top end of d) a latch-side z-bar; wherein the latch-side z-bar or, more typically, the hinge-side z-bar comprises an installation notch near its top end.

In another aspect, the present disclosure provides a ready-to-install door system comprising, prior to installation: a) a door, which is rotatably attached on a hinge-side edge to b) a hinge-side z-bar, which is permanently attached at a top end to c) a drip cap, which is permanently attached to a top end of d) a latch-side z-bar; where at least one of the z-bars comprises at least one screw holder assembly comprising: e) a screw holder mounting hole in the z-bar; f) a screw holder mounted in the screw holder mounting hole; and g) a screw driven into the screw holder.

In another aspect, the present disclosure provides a screw holder adapted to hold a screw in a stable position relative to a screw holder mounting hole in a first substrate, prior to driving the screw to attach the first substrate to a second substrate, comprising: a) a screw holder body having a screw-point end, pointing in a screw-point direction, and a screw-head end, pointing in a screw-head direction, having a hollow interior open at the screw-head end for receiving a screw into the hollow interior, where the screw holder body has an outer perimeter adapted to fit into the screw holder mounting hole in the first substrate; b) a collar portion at the screw-point end of the screw holder body adapted to prevent the screw holder from passing entirely through the screw holder mounting hole in the screw-head direction; c) one or more locking extensions extending from the screw holder body, which are compressible against or into the screw holder body to allow the screw holder to be inserted into the screw holder mounting hole in the screw-head direction and which rebound after insertion to prevent the screw holder from passing out of the screw holder mounting hole in the screw-point direction.

In another aspect, the present disclosure provides methods of installing a ready-to-install door system comprising the steps of: a) providing a ready-to-install door system according to the present disclosure; b) driving an installation screw into a frame of a door opening at a pre-determined distance from the top of the door opening; c) positioning the ready-to-install door system so that it hangs from the installation screw by the installation notch; and d) further attaching the ready-to-install door system to the frame of the door opening, typically by fully driving screws mounted in screw holders.

In yet another aspect, the present disclosure provides a ready-to-install door system comprising, prior to installation: a door, which is rotatably attached on a hinge-side edge to a hinge-side z-bar, which is attached at a top end to a drip cap, which is attached to a top end of a latch-side z-bar; where at least one of the z-bars includes at least one preloaded screw and a mounting hole.

In even yet another aspect, the present disclosure provides a screw holder adapted to hold a screw in a stable position relative to a mounting hole in a first substrate, prior to driving the screw to attach the first substrate to a second substrate, comprising a) a screw holder body having a screw-point end, pointing in a screw-point direction, and a screw-head end, pointing in a screw-head direction, having a hollow interior open at the screw-head end for receiving a screw into the hollow interior, where the screw holder body has an outer perimeter adapted to fit into the mounting hole in the first substrate; b) a collar portion at the screw-point end of the screw holder body adapted to prevent the screw holder from passing entirely through the mounting hole in the screw-head direction; and c) one or more locking extensions extending from the screw holder body, which are compressible against or into the screw holder body to allow the screw holder to be inserted into the mounting hole in the screw-head direction and which rebound after insertion to prevent the screw holder from passing out of the mounting hole in the screw-point direction.

In a further aspect, the present disclosure provides a method of installing a ready-to-install door system comprising the steps of: a) providing a ready-to-install door system including: a door, which is rotatably attached on a hinge-side edge to a hinge-side z-bar, which is attached at a top end to a drip cap, which is attached to a top end of a latch-side z-bar; where at least one of the z-bars comprises at least one screw and a mounting hole, b) positioning the ready-to-install door system within or adjacent to a frame of the door opening; and c) attaching the ready-to-install door system to the frame of the door opening with the at least one preloaded screw.

Additional embodiments of the door systems, screw holders, and methods of the present disclosure are described below under "Selected Embodiments."

The preceding summary of the present disclosure is not intended to describe each embodiment of the present invention. The details of one or more embodiments of the invention are also set forth in the description below. Other features, objects, and advantages of the invention will be apparent from the description and from the claims.

In this application:

"finished front-facing surfaces" on door frame components do not require the addition of weather strip or other finishing materials to close the door opening to ingress of air, water or weather;

"generally planar" refers to a part having a non-zero thickness and two opposing faces which are each planar to within +/−10%, 5%, or 1% and plane-parallel to within +/−10%, 5%, or 1%;

"live bolt" means a spring-loaded bolt which emerges from a bolt hole in the edge of a door, which is normally extended unless retracted by operation of mechanisms such as door knobs, door handles, automated mechanisms, or the like, and is contrasted with a dead bolt.

All scientific and technical terms used herein have meanings commonly used in the art unless otherwise specified.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

It is an advantage of the present disclosure to provide a door system which may be installed rapidly, typically in less than 10 minutes.

BRIEF DESCRIPTION OF THE DRAWING

FIGS. 3*b* and 3*c* illustrate a preloaded or installed installation screw and corresponding screw holder, respectively.

DETAILED DESCRIPTION

The present disclosure provides a quick-install door system and unique components thereof.

The disclosed door system provides installation advantages when compared, for example, to a conventional or traditional storm door installation kit. The installation of the present door system is much quicker and more efficient. Pre assembly of the closer and lockset avoid the time-consuming steps of separate installation processes required by a conventional kit. In addition, the pre-assembled door system allows the installer to easily position and hang the door system from a single installation screw in a framed door opening in a single operation. All the components are properly positioned in a single step. Further, pre-loading the installation z-bar screws in the disclosed screw holders or screw holder assemblies allows the installer to quickly drive the screws without having the potential for the door components to move or shift position when driving individual installation screws and the preloaded screws are all driven from the readily accessible front of the door system. Still further, pre-assembly of the door system ensures the system components remain properly aligned with respect to each other during the installation. Proper alignment of the system components avoids any potential binding or other problems, for example, of the door opening, closing and latching.

Figure 1:
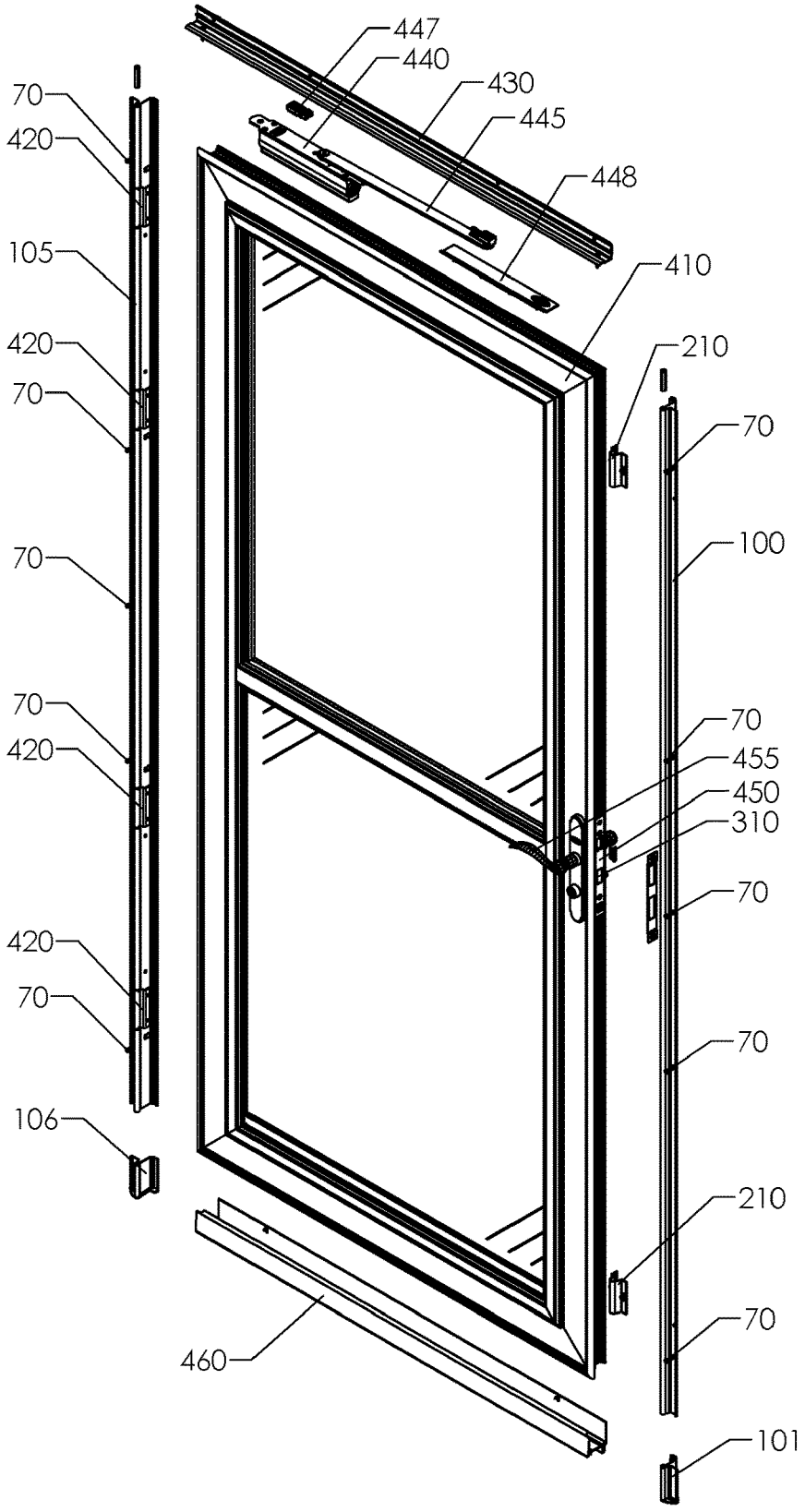
FIG. 1 is an exploded isometric view of the disclosed door system.

With reference to FIG. 1, one embodiment of a door system according to the present disclosure comprises: door 410 attached by hinges 420 to hinge-side z-bar 105; which is attached to drip cap 430; which is attached to latch-side z-bar 100. According to various embodiments, the hinge-side z-bar 105 can be permanently attached to the drip cap 430. According to some embodiments, the drip cap 430 can be permanently attached to the latch-side z-bar 100. Door 410 is typically a storm door. Door 410 can have one or more face, e.g., an interior face and an exterior face. Typically, an in-door closer 440 is pre-installed in door 410 and closer arm 445 is rotatably attached to a slider which is slideably attached to drip cap 430. The in-door closer 440 can be attached to a face of the door. In some embodiments, closer hardware is as described in one or more of the following patent applications, incorporated herein by reference: 15/382,275; 15/911,639; 15/911,690; and Ser. No. 15/385,091. The door closer can comprise a single segment closer arm 445 as shown with reference to FIGS. 6, 7A, 7B, 14A, 14B, and 15, or can be a multi-segment closer arm (not shown). An example of a multi-segment closer arm comprises two or more segments (or pieces) connectable at a hinge point. The closer arm can comprise an attachment feature on one end of the closer arm attached to the door (e.g., a vertical pinion connecting stud) and an attachment feature on the opposite end of the closer arm attachable to the drip cap or framing around the door assembly. The multi-segment closer arm is capable of folding at the hinge point, wherein a first segment and a second segment are located side by side when folded at the hinge point. Still further, if the closer arm comprises more than two segments, each segment may be folded over at the hinge points to be located side by side, or in a stacked configuration. Each segment may be the same length, or alternatively, the segments may be different lengths. The hinge point may comprise an elbow hinge, a revolute joint, a knuckle joint, or other types of similar joints. In addition drip cap 430 includes hold-open stop 447. Typically, lock set 450 is pre-installed in door, with or without handles 455 attached. If handles are not yet attached, the live bolt may be maintained in a retracted position with a live bolt retainer, described below. Typically door 410 and latch-side z-bar 100 are held together with the preferred spacing and orientation with one or more z-bar clips 210. Z-bar clips 210 are removed after installation of the door system. Typically, z-bars 100 and 105 bear screw holder assemblies 70 (or screw holders 10), described below. Cover plate 448 covers an opening which would contain in-door closer 440 if the door opened in the opposite direction. It will be understood that the present figures depict a left-hinge door; however, right-hinge doors are also contemplated. Z-bars 100 and 105 may include z-bar extenders 101 and 106. Door 410 may include bottom expander 460.

Figure 14A:
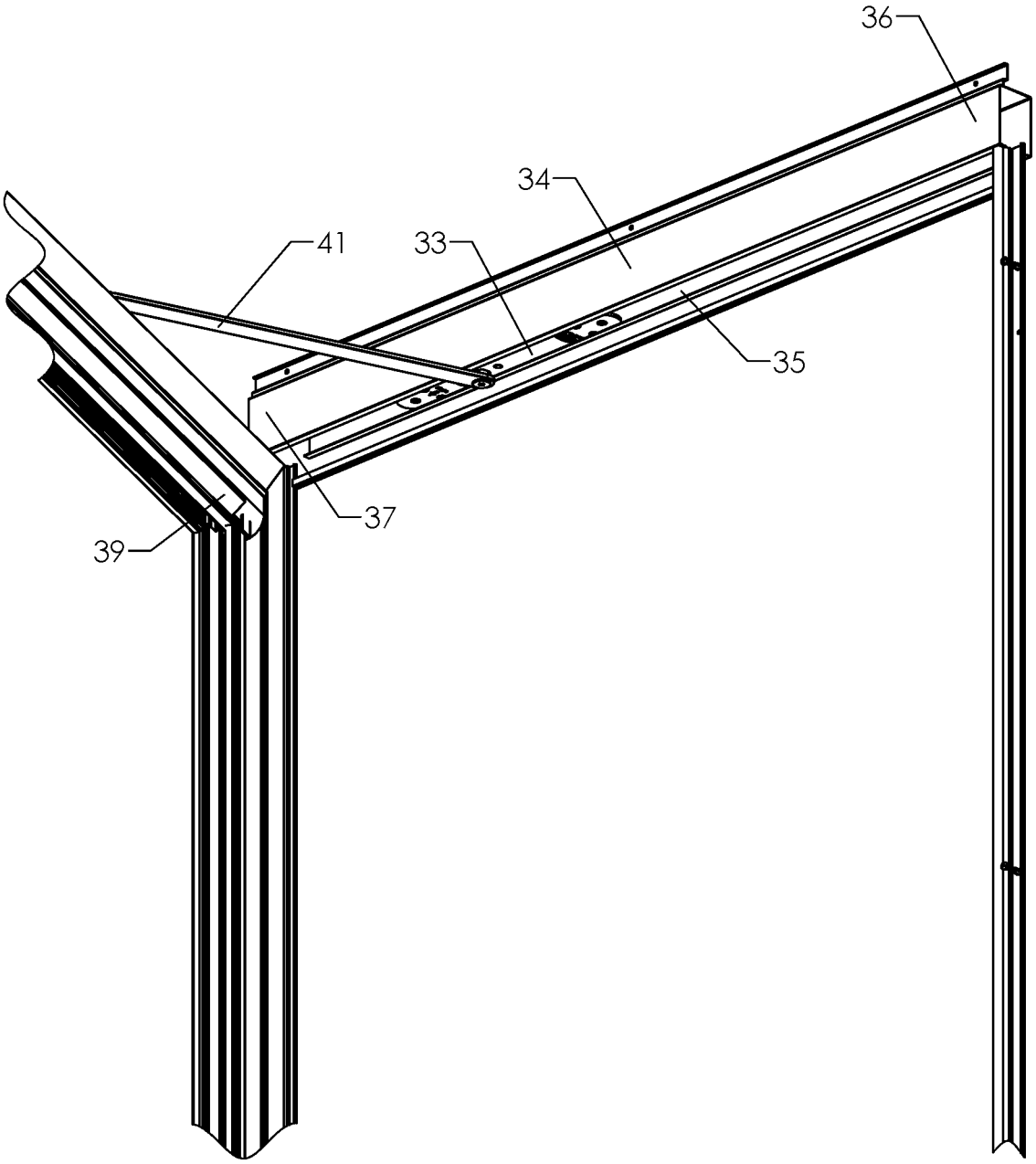
FIG. 14A is a perspective view of a door closer fitted in a downward facing opening in a u-shaped channel in a dip cap.
Figure 14B:
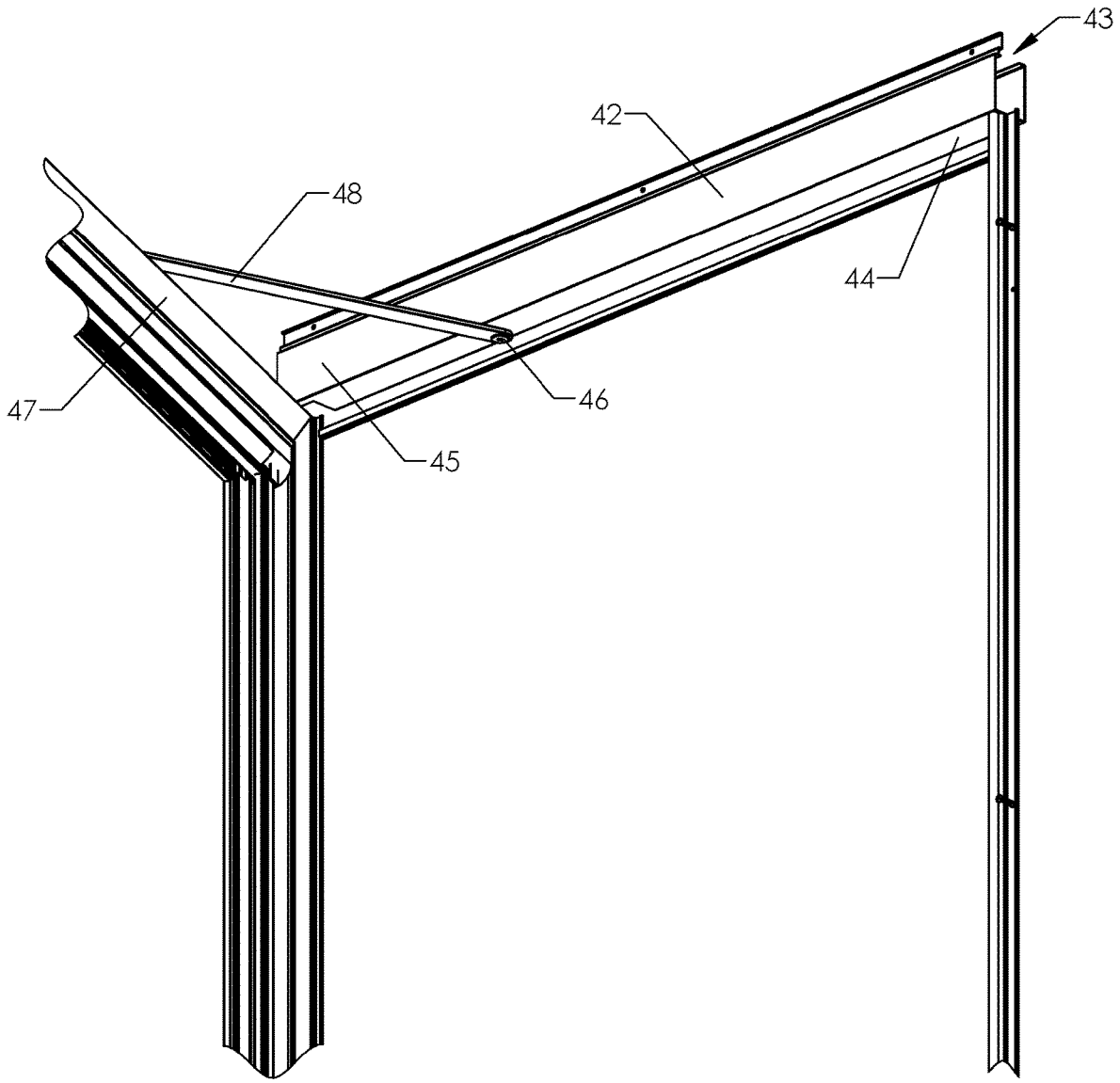
FIG. 14B is a perspective view of a hidden door closer fitting in an upward facing opening in a u-shaped channel in a drip cap.
Figure 15:
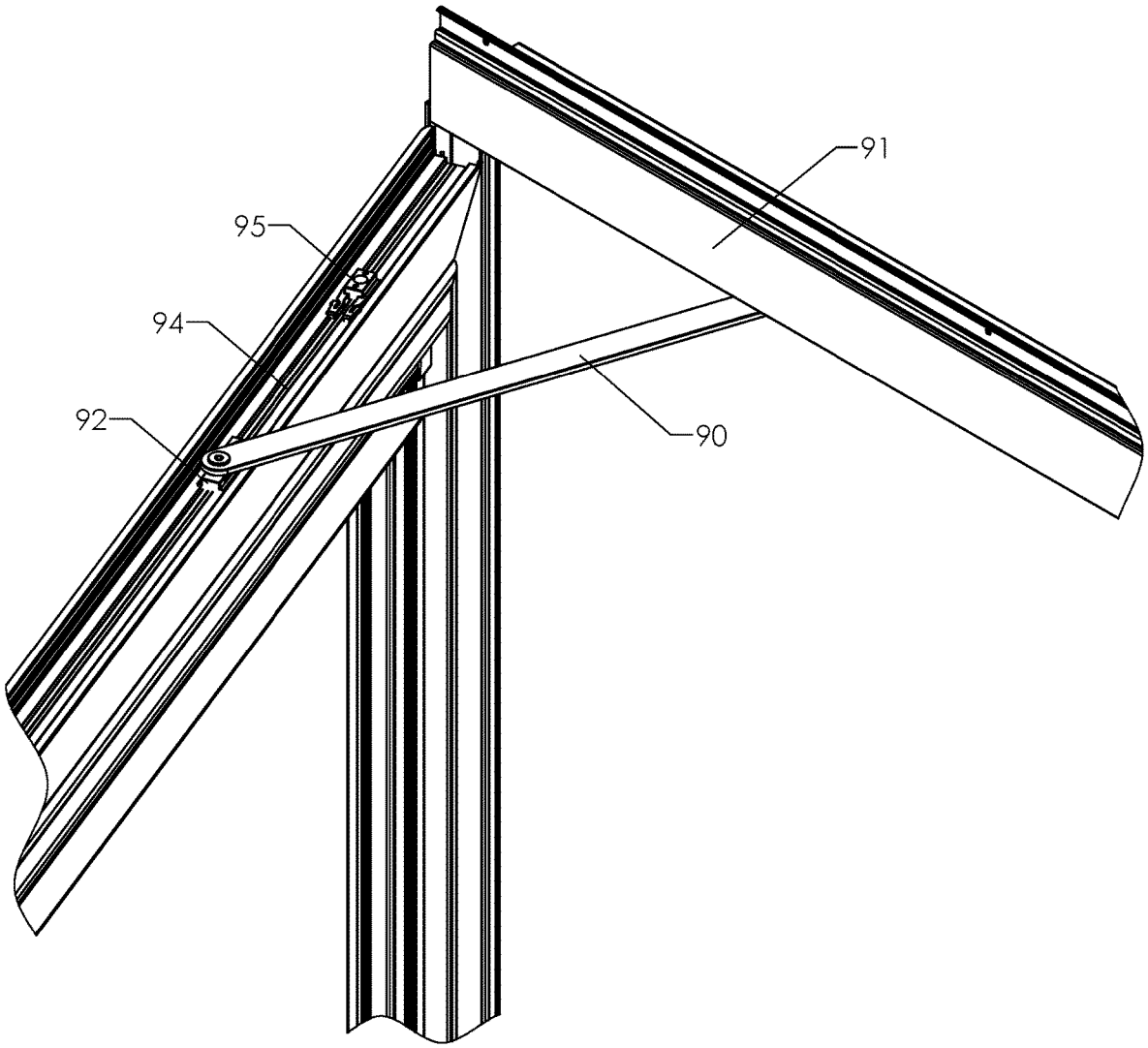
FIG. 15 is a perspective view of a slide track associated with an upper rail of a left hinged door assembly.

In other embodiments, and as shown with reference in particular to FIGS. 14A, 14B, and 15, door closer hardware is contained within a portion of the drip cap and comprises a closer arm rotatably attached to a slider, which is slideably attached to the door. The in-drip cap closer is preinstalled in the drip cap and closer arm is rotatably attached to a slider which is slideably attached to door.

As shown with reference to FIG. 14A, a drip cap 34 houses a concealed closer 33 having a channel (or slot) 35 along a bottom edge of the drip cap 34. As shown with reference to FIG. 14B, a drip cap 42 houses a concealed closer (not shown) having a channel (or slot) 43 along a top edge of the drip cap 42.

FIG. 14A illustrates a drip cap having a u-shaped channel that extends between each of the ends of the drip cap. In this illustrated embodiment, the open section of the u-shaped channel faces downward toward the upper rail of the door frame. Specifically, FIG. 14A shows drip cap 34 having an open channel 35 extending between each end 36 and 37 of the drip cap. The open section of the channel in the drip cap faces the upper rail 39 of the door. FIG. 14A further illustrates door closer 33 fitted or housed in channel 35, as well as closer arm 41 secured to the closer and slide fixture inserted in the slide track associated with the upper rail of the door.

FIG. 14B illustrates an alternative embodiment of a drip cap having a u-shaped channel that extends between each of the ends of the drip cap. In this embodiment, the open section of the u-shaped channel faces upward away from the upper rail of the door. FIG. 14B shows a drip cap 42 with a u-shaped channel 43 extending between the ends 44 and 45 of the drip cap. A door closer (not visible) is hidden or concealed in the channel. A connecting stud 46 of the hidden closer extends downward through an opening in drip cap 42 and is attached or secured to the closer arm 48. The closer arm 48 is also attached or secured to the slide fixture inserted in the slide track associated with the upper rail 47 of the door frame. In alternative embodiments, the channel 43 can be omitted along the top edge of the drip cap and all faces of the drip cap can be solid or continuous.

FIG. 15 illustrates a closer arm 90 attached to slide fixture 92 inserted into slide track 94 and hold-open stop 95 that are associated with the upper horizontal rail of the door frame. Hold-open stop 95 also fitted or inserted in slide track 94 and functions to limit the door swing when the door is moved to its most open position, and can keep the door in a fixed stay-open position, if desired, and then can be released from the stay-open position for the door to close. The view shown in FIG. 15 can be the same whether there is a channel (or slot) along the bottom edge of a drip cap 91, a lot along a top edge of the drip cap 91, or no channel in the drip cap 91 since those features would not be visible from the angle shown.

Installation Process

The disclosed door system is readily installed in, within, or adjacent to a framed door opening using the following steps.

Figure 2A:
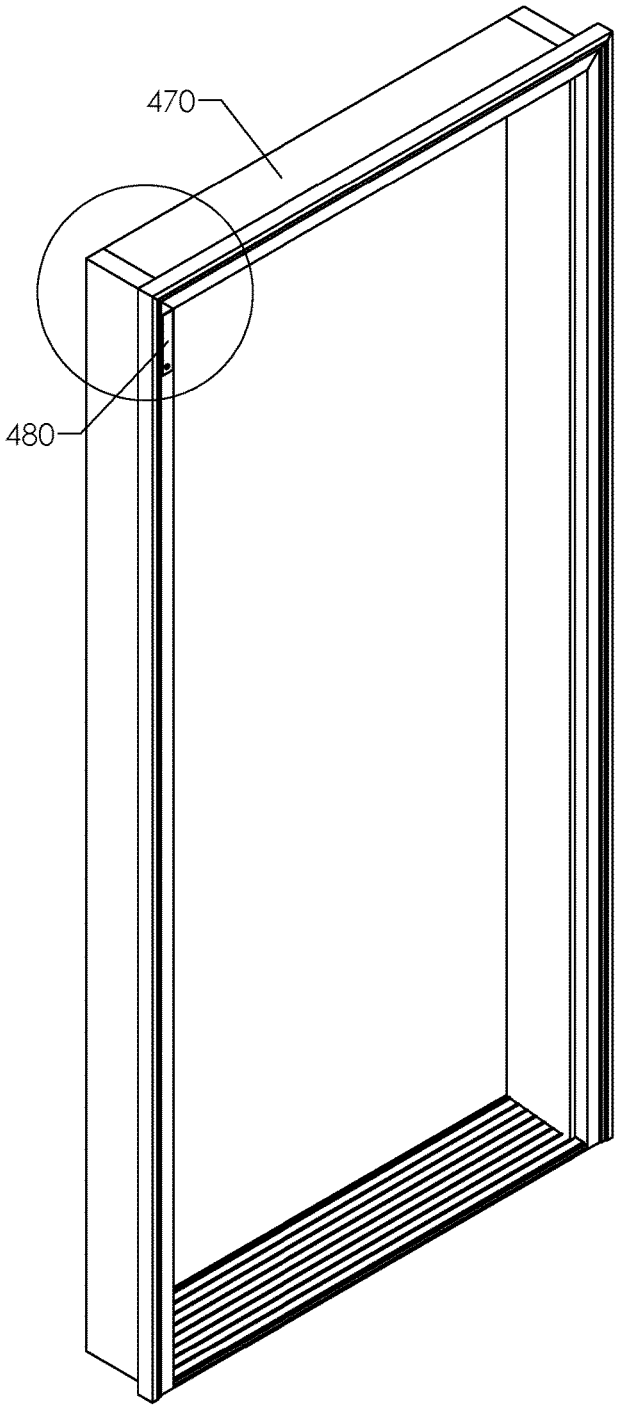
FIGS. 2*a* and 2*b* are an isometric view and expanded view of a framed door opening with an installation template before installation of the disclosed door system.
Figure 2B:
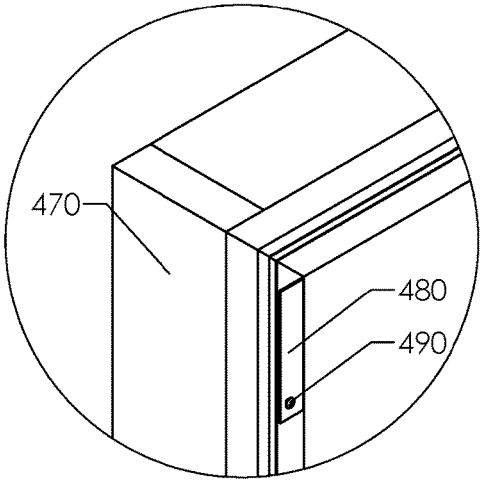

An installation screw 490 is fitted to the door frame (e.g., of a door opening) using a template 480. As illustrated in FIGS. 2*a* and 2*b*, the template 480 in aligned with the upper corner of the hinged side of the door frame 470 and an installation screw 490 is partially driven through the template 480 at the indicated site on the template 480. Once the installation screw is partially driven, the template 480 is removed from the door frame 470.

Figure 3A:
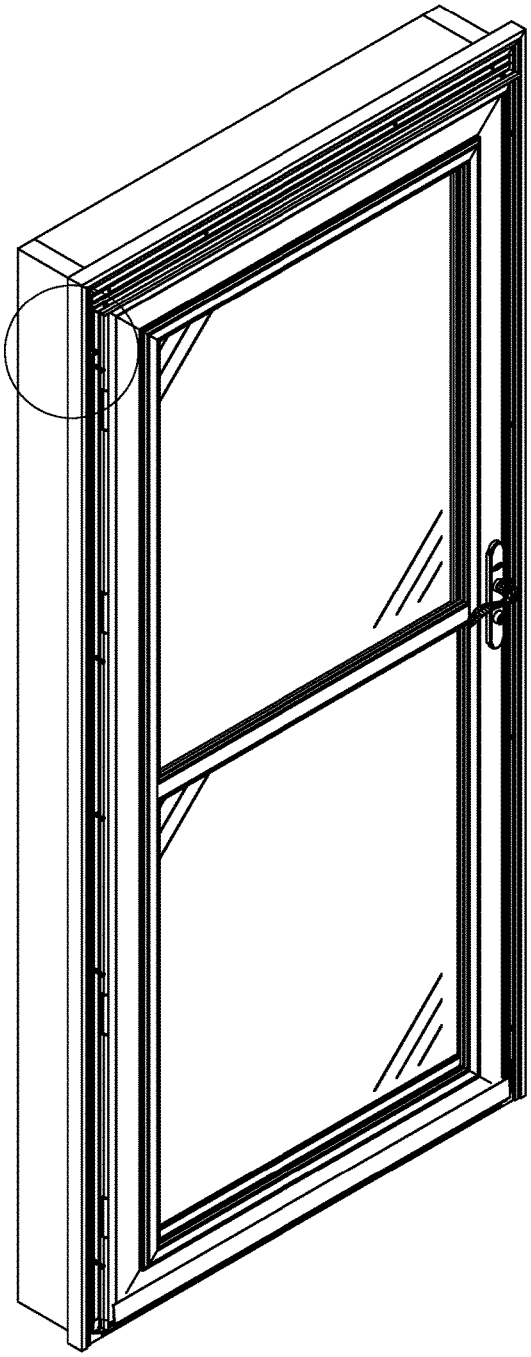
FIGS. 3*a*, 3*b* and 3*c* are an isometric view of the disclosed door system hanging in the door opening from an installation screw attached to the framed door opening, an expanded view of the notched hinge z-bar, and an expanded view of the installation screw and notched hinge z-bar. Both
Figure 3B:
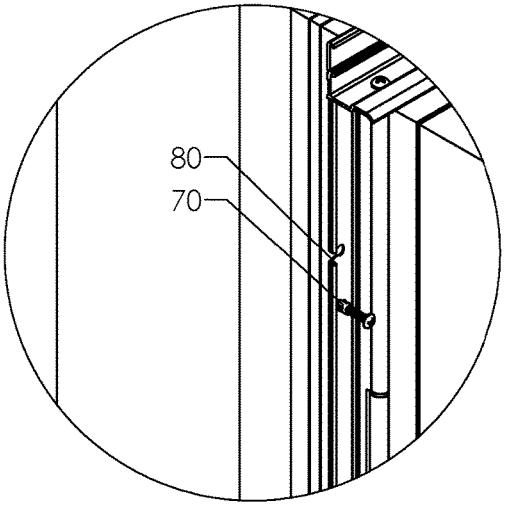
Figure 3C:
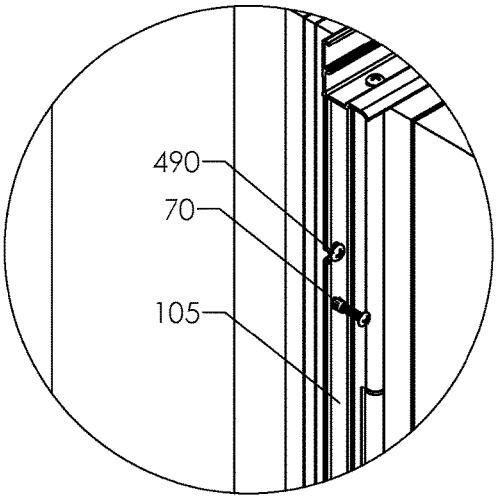

The door system is fitted in the door frame by hanging the door system from the installation screw 490 using the installation notch 80 in the upper portion of the hinge z-bar 420. The isometric view of FIG. 3*a* illustrates the door system hanging from the installation notch 80 in the hinge-side z-bar 105. The expanded views of FIGS. 3*b* and 3*c* further illustrate the installation screw 490 and the hinge-side z-bar 105 with installation notch 80 as well as the preloaded screw holder assembly 70, including a z-bar screw and screw holder. As contemplated herein, a screw holder assembly 70 comprises a screw holder 10 and a screw, e.g., an installation screw. The screw can be a z-bar screw.

According to some embodiments, the screw holder assembly 70 can include a preloaded screw, which can be preloaded into screw holders. A preloaded screw, as used herein, can denote a screw that was pre-installed into a screw holder 10 prior to sale or prior to leaving a place of manufacture, such as a factory.

Once the door system is hung from the installation screw, the preloaded hinge and latch z-bar screws are driven into the door frame. It is an advantage of an embodiment of the present system that all of these screws are front facing and preloaded into the screw holders, for easier installation. In addition, installation screws are driven into the door frame to secure the drip cap. The drip cap includes holes for positioning these installation screws.

Figure 4A:
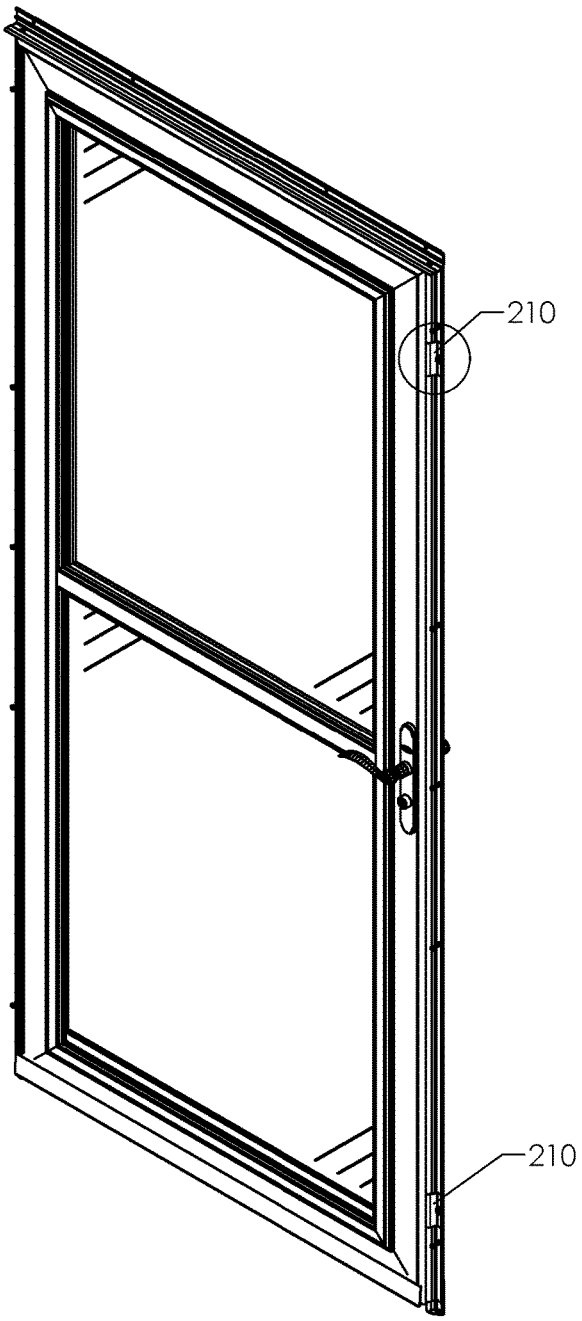
FIGS. 4*a* and 4*b* are an isometric view of the disclosed door system and an expanded view of the z-bar clips of the door system.
Figure 4B:
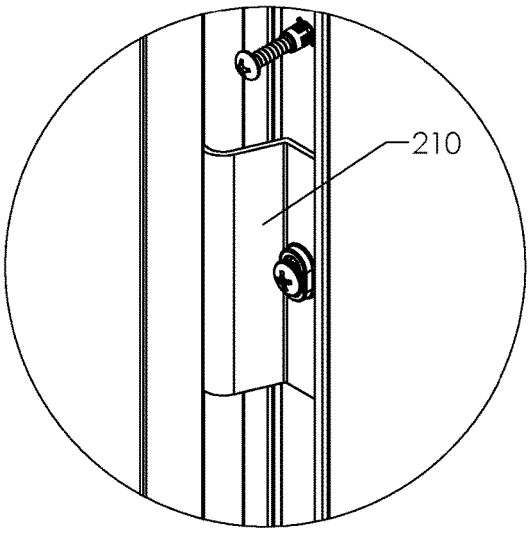
Figure 5B:
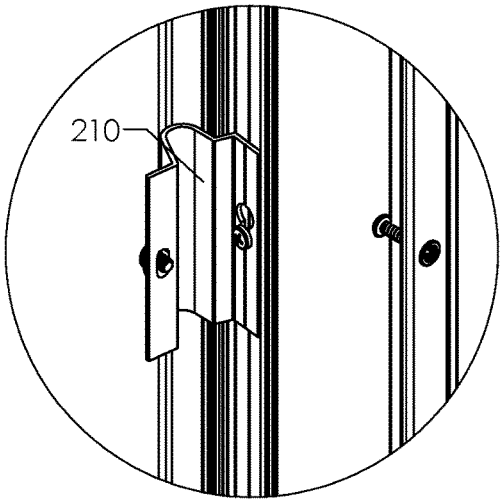
FIGS. 5*a*, 5*b* and 5*c* are an interior isometric view of a slightly opened (about 5°) door system that includes expanded views of both the z-bar clip, and the lockset live bolt retainer of the door system, respectively.
Figure 5C:
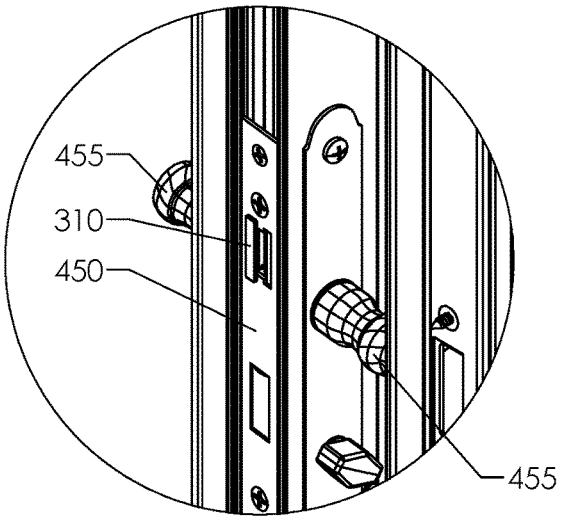
Figure 5A:
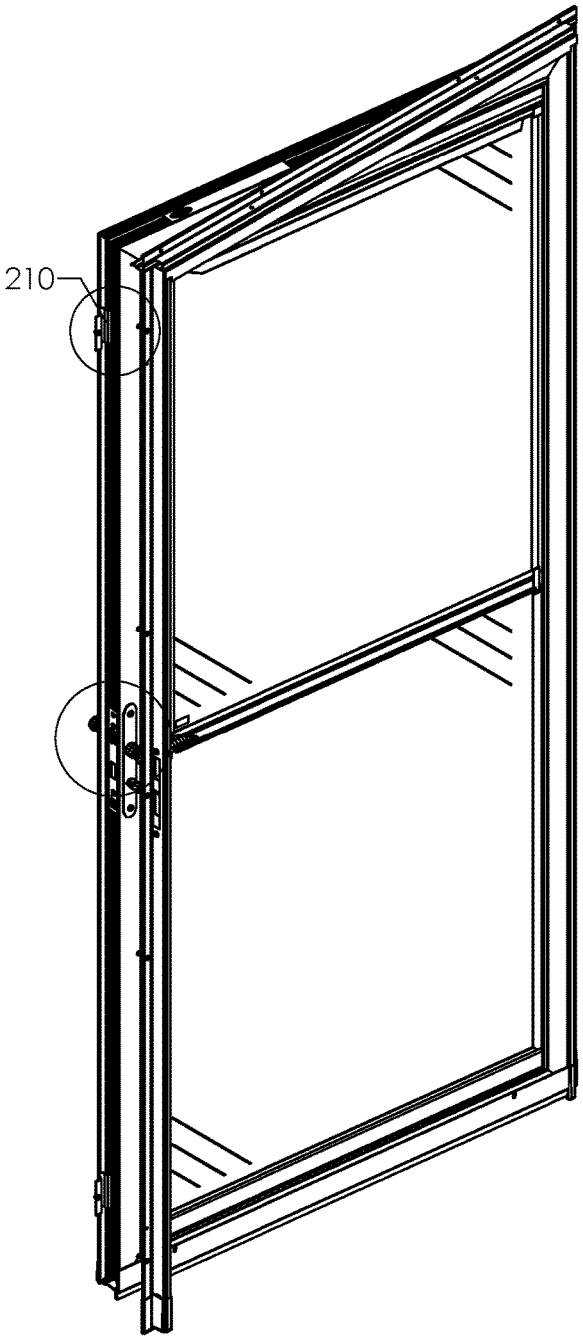

Once the drip cap, hinge and latch z-bar installation screws are secured, the upper and lower z-bar clips 210 are removed from the latch z-bar 100 and door 410 by first removing the screws securing the clips to the latch z-bar. The expanded view of FIG. 4*b* illustrates the z-bar clip 210 and the screw securing the clip to the latch z-bar 100. When this screw is removed, the screws securing the clip to the door may be removed. These securing screws are exposed by opening the door and are illustrated in the expanded view in FIG. 5*b*. The securing screws only need to be loosened enough to allow the clips to be removed from the door via the keyhole-shaped holes, and the securing screws may then be tightened against the edge of the door to prevent open, visible holes from remaining in the door. The lockset handles 455 may be fitted at the stage in the process as the door system is securely mounted to the door frame.

When the door is opened, the lockset live bolt retainer 310, to keep the live bolt in a retracted position, may also be removed in order to allow the live bolt to move in and out of the lockset in a conventional manner. Without the retainer, the live bolt would extend into a mating hole in the latch z-bar, preventing the door from being able to be opened since the lockset handles have not yet been fitted (and can't be since the door would still be latched in the closed position). With the door opened, additional installation screws are driven into holes located in the drip cap to further secure the drip cap to the door frame.

The bottom expander 460 may be adjusted for the bottom of the door system to properly align with the threshold of the door frame. This adjustment allows for the seal at the bottom the expander to lightly brush against the threshold.

Figure 6:
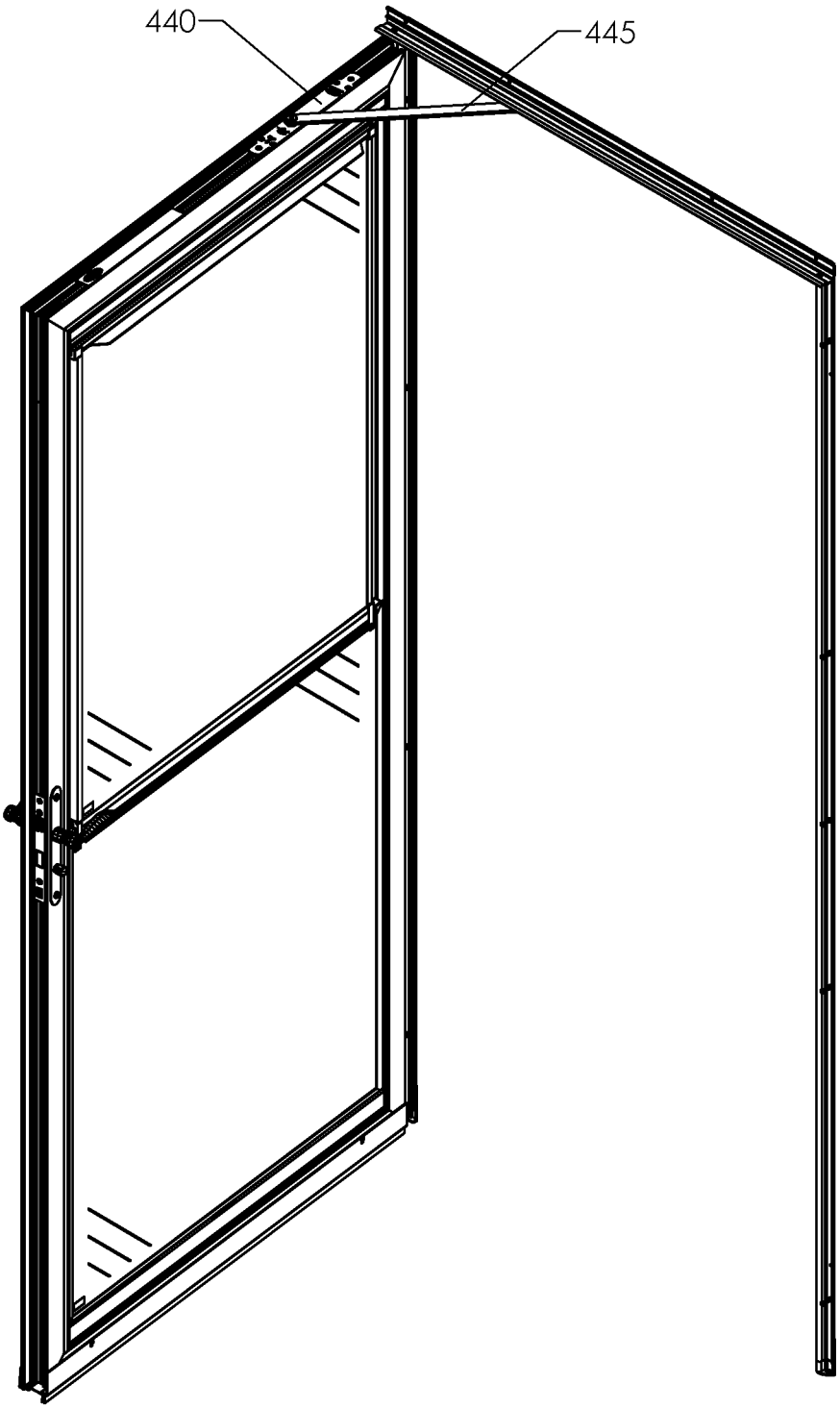
FIG. 6 is an upper perspective isometric view of a fully opened (about 90°) door system that illustrates the closer fitted in a pocket in the upper rail of the door system.
Figures 7A, 7B:
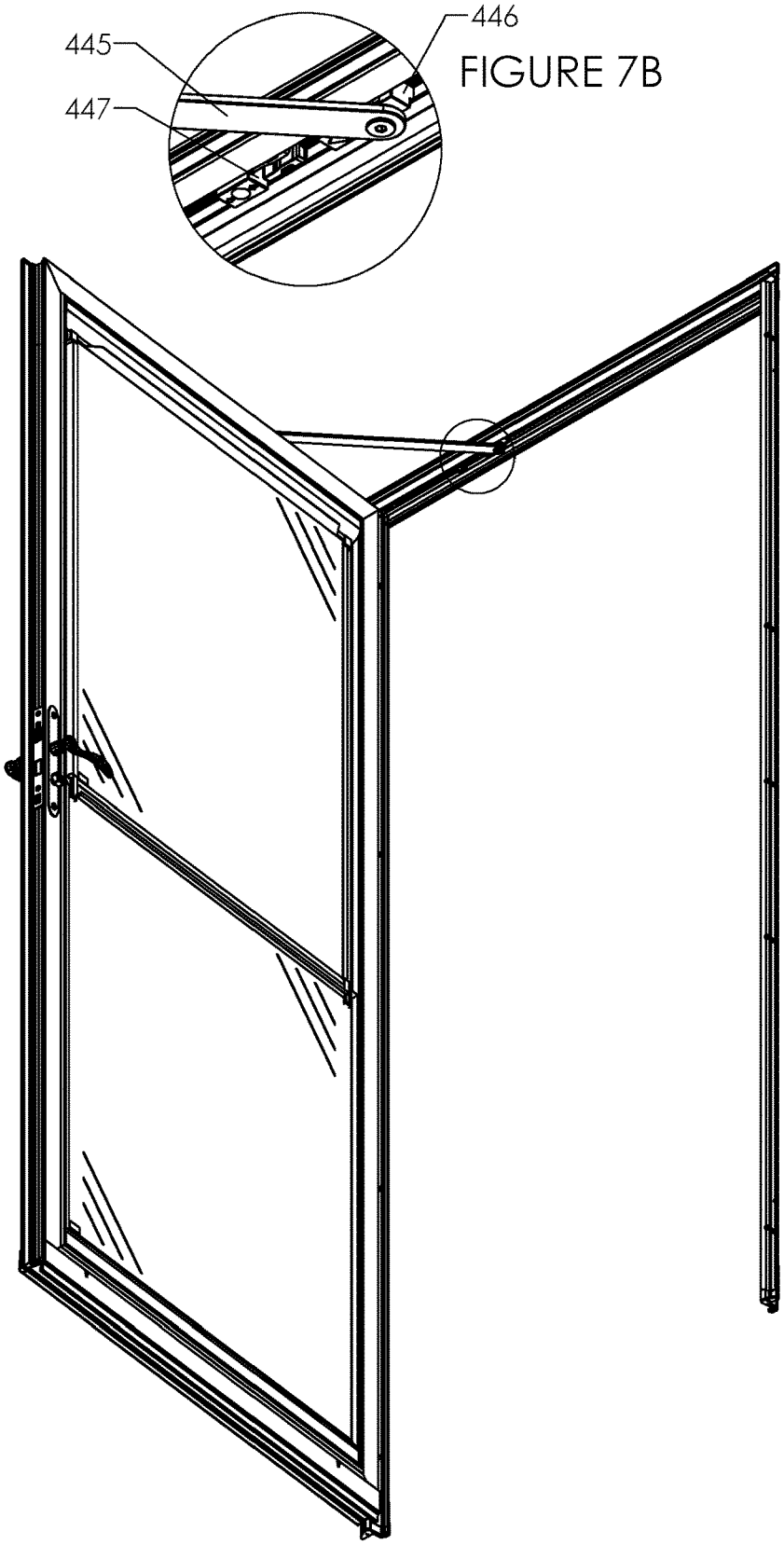
FIGS. 7*a* and 7*b* are a lower perspective isometric view of an opened (about 85°) door system and an expanded view of the closer slide and the hold-open stop.
Figure 8A:
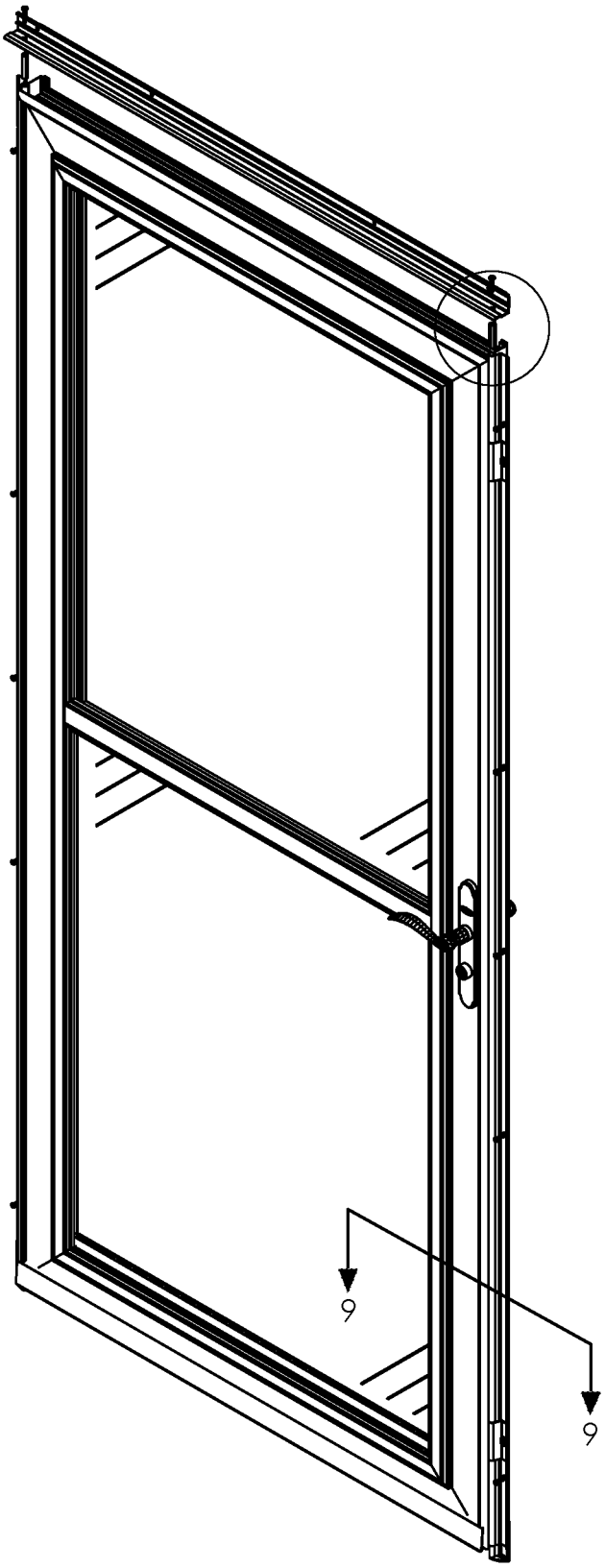
FIGS. 8*a* and 8*b* are an isometric view and an expanded view of the disclosed door system that includes an expanded view of the drip cap connector of the door system.
Figure 8B:
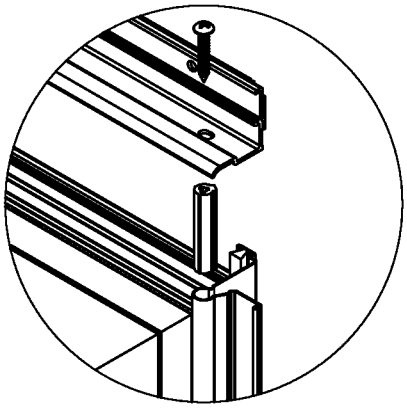

If needed, adjustments may be made to the closer 440 in order to set the door swing positioning and hold-open stop 447. Preferably the hold-open stop 447 has been preinstalled to hold the door open at 90° without any adjustment necessary by the installer. However, if physical obstructions prevent the door from opening to a full 90° or it is desired to hold the door open at an angle slightly greater than 90°, the location of the hold-open stop can be adjusted to hold the door open at some other desired angle. The closer, for example, may be adjusted to allow the door to open 90° and then engaged the hold-open stop. FIG. 6 illustrates the closer adjusted to allow the door to open about 90°. The expanded view of FIG. 7*b* illustrates the closer slide 446 before the closer slide engages the hold-open stop 447.

Screw Holder

Figure 9:
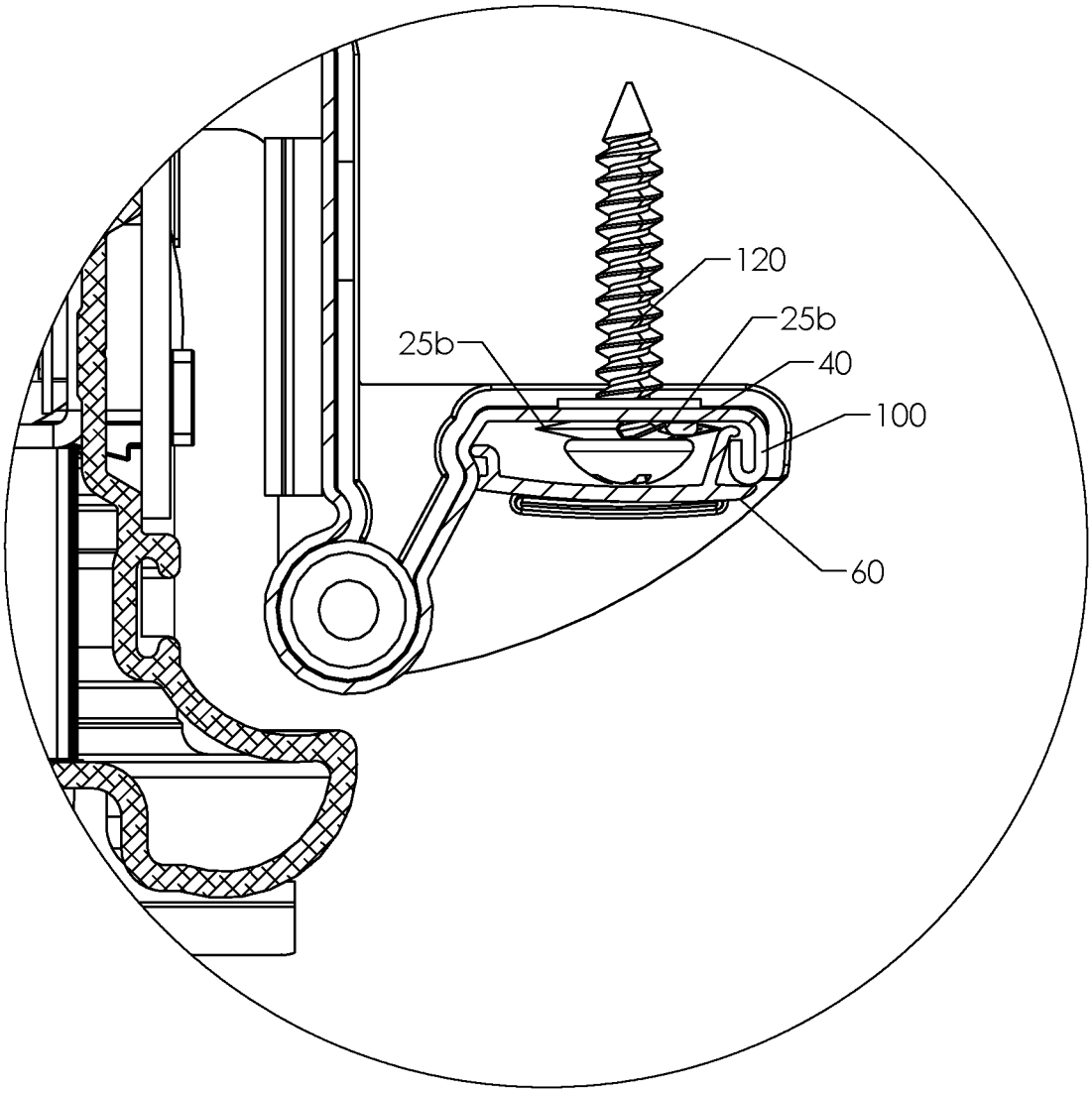
FIG. 9 is a cross section view taken along section line 9-9 of FIG. 8*a* illustrating a z-bar with the installation screw and screw holder in an installed, driven position, and screw cover molding.

FIGS. 9, 10*a-c*, and 11*a-d* depict one embodiment of a screw holder 10 according to the present disclosure. As described herein, the screw holder 10 can be a part of a screw holder assembly 70. Screw holder 10 includes a screw holder body 20 having the appropriate perimeter or circumference to fit a screw holder mounting hole in a first substrate such as z-bar 100. The screw holder has a screw-point end C, pointing in a screw-point direction D, and a screw-head end A, pointing in a screw-head direction B. The screw holder body 20 has a hollow interior open at the screw-head end A for receiving a screw 120 into the hollow interior. Typically, the screw holder body 20 is also open at the screw-point end C; however, in some embodiments screw-point end C is closed until pierced by screw 120 when screw 120 is driven into the second substrate (not shown). Screw holder 10 includes a collar portion 30 at the screw-point end C of the screw holder body 20 adapted to prevent screw holder 10 from passing entirely through the screw holder mounting hole in the screw-head direction B. In some embodiments, screw holder 10 includes one or more locking extensions 40 extending from screw holder body 20, which are compressible against or into screw holder body 20 to allow screw holder 10 to be inserted into the screw holder mounting screw in the screw-head direction B. Locking extensions 40 rebound after insertion to prevent screw holder 10 from passing out of the screw holder mounting screw in the screw-point direction D. In some embodiments, locking extensions 40 splay out flat against the substrate (such as z-bar 100) when screw 120 is fully driven into screw holder 10 (see splayed locking extension 40*a* in FIG. 10*c*). Screw holder 10 may additionally include orienting projections 50 on the side of collar portion 30 facing in the screw-head direction B. In such an embodiment, the receiving screw holder mounting hole includes a positioning notch and orienting projection 50 fits into the positioning notch to provide proper alignment of screw holder 10. In some embodiments, screw holder body 20 comprises wall segments 25 adapted to fold outward when screw holder 10 is mounted in a screw holder mounting hole and screw 120 is fully driven into screw holder 10 (see folded wall segments 25*b* in FIGS. 10*b* and 10*c*) such that screw holder 10 is fully collapsed. These embodiments have the advantage that folded wall segments 25*b* do not extend far from screw 120 after installation. In the depicted embodiment where the substrate is z-bar 100, screw heads will be hidden under a screw head cover 60 (FIG. 9) which snaps into a channel in z-bar 100 after all screws 120 are fully driven. Since folded wall segments 25*b* do not extend far from screw 120 after installation, they do not interfere with installation of screw head cover 60 (FIG. 9). In an alternate embodiment (not shown), screw holder body 20 may include break lines which may comprise furrows, scoring, perforations, or the like, running lengthwise from the screw-head end A toward the screw-point end C, where the break lines are adapted to break when screw 120 is fully driven into screw holder 10.

The screw holder 10 may be made of any suitable material. In some embodiments, the screw holder 10 is a unitary construction comprising a single piece of material. In some embodiments, the screw holder material is a polymeric material. In some embodiments, the screw holder material is a thermoplastic material. In some embodiments, the screw holder material is a moldable material. In some such embodiments, the screw holder is a unitary construction made in a single molding. In some embodiments, where the screw holder 10 provides mechanical isolation between the first and second substrates, the screw holder material is an elastomeric material. In some embodiments, where the screw holder 10 provides electrical isolation between the first and second substrates, the screw holder material is an electrically non-conductive material.

The first substrate may be made of any suitable material. Suitable materials may include metals, plastics, fiber/resin composites, glass, ceramic or stone; and are most typically metals. The second substrate may be made of any suitable material for attachment by a screw, which may include wood, plastic, sheet metal, or the like. The screw may be of any suitable type, which may include wood screws or sheet metal screws.

Figure 10A:
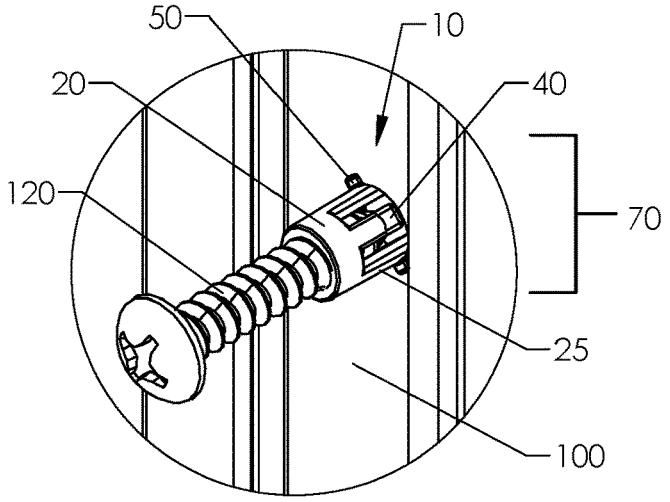
FIGS. 10*a*, 10*b* and 10*c* illustrate an installed screw and screw holder in a z-bar of the door system, a partially driven screw illustrating an initial collapse of the screw holder, and a fully driven screw illustrating a final collapse of the screw holder, respectively.
Figure 10B:
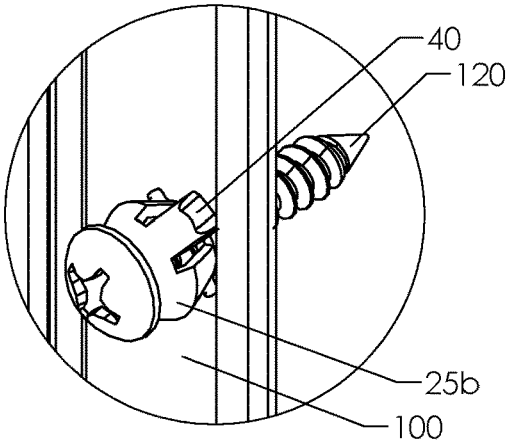
Figure 10C:
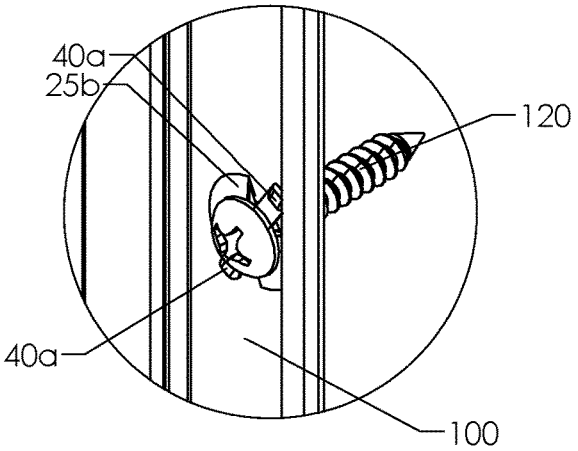
Figure 11A:
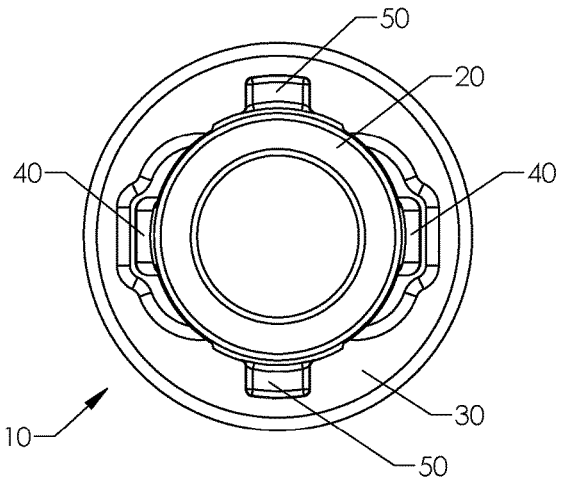
FIGS. 11*a*, 11*b*, 11*c* and 11*d* are top, isometric, and side views of an embodiment of a z-bar installation screw holder, respectively.
Figure 11B:
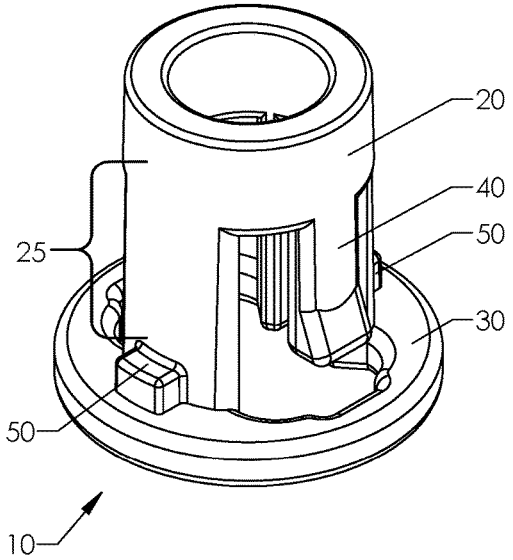
Figure 11C:
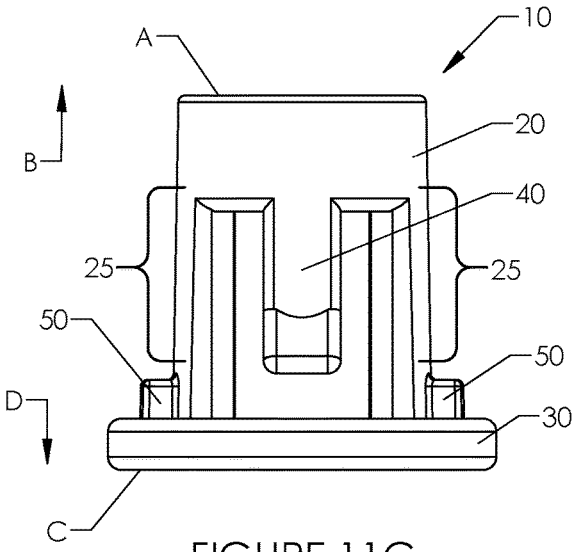
Figure 11D:
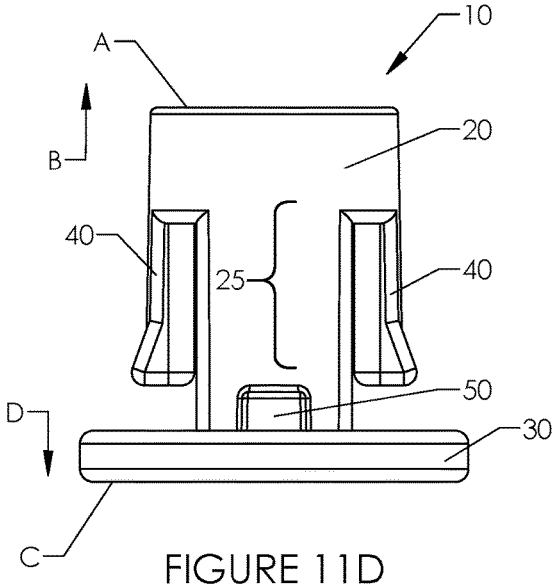

FIG. 10*a* depicts one embodiment of a screw holder assembly 70 according to the present disclosure. The screw holder assembly 70 includes screw 120 mounted in screw holder 10 (including screw holder body 20, wall segments 25, and locking extensions 40) mounted in a screw holder mounting hole in z-bar 100. Screw 120 is partially driven into screw holder 10, to the extent that it is held in place and ready to be fully driven once the assembly is properly located vis-a-vis the second substrate. In this embodiment screw holder body 20 has an internal diameter less than the outer diameter of the threads of screw 120.

Z-Bar Clip

Figure 12:
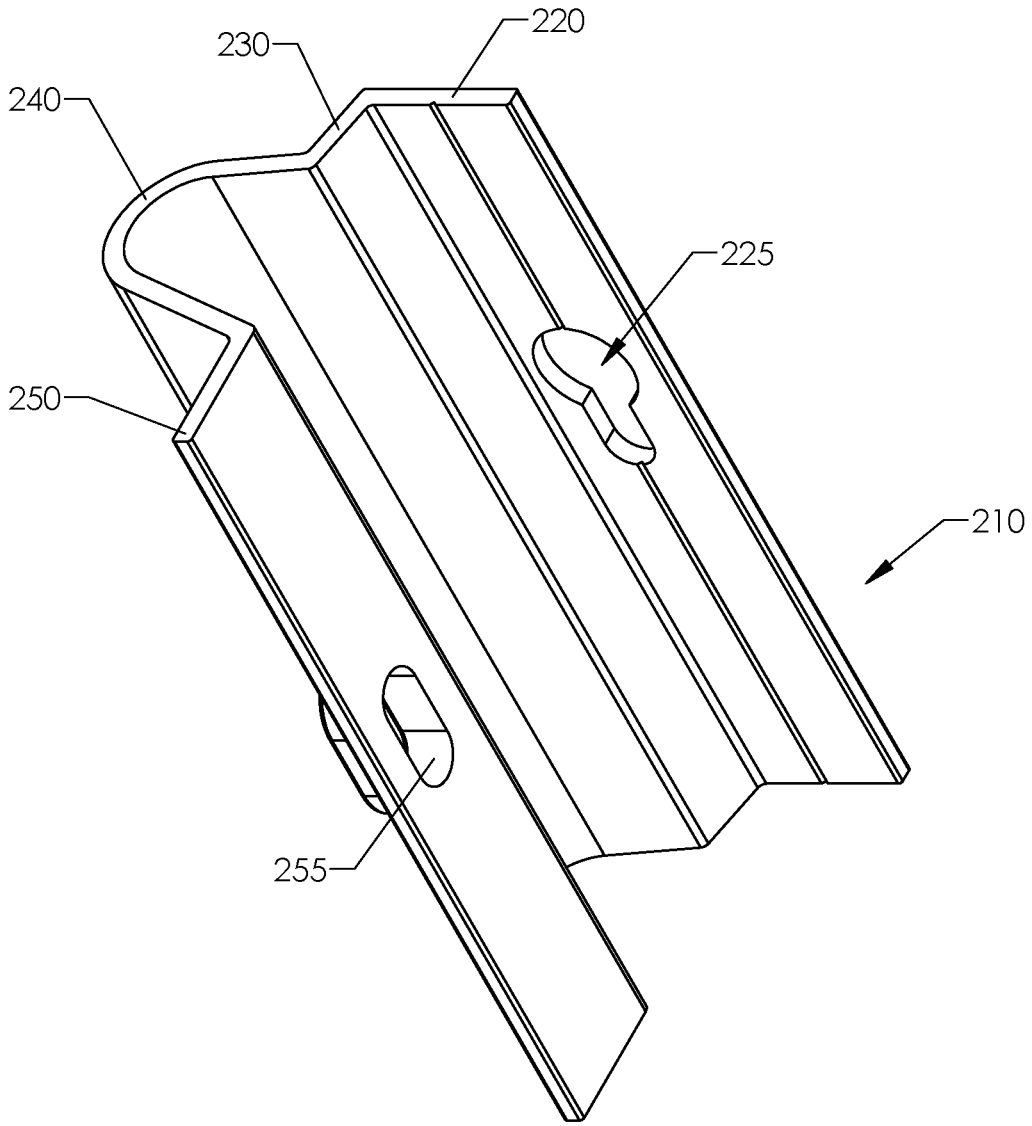
FIG. 12 is a view of one embodiment of a z-bar clip of the disclosed door system.

FIG. 12 depicts one embodiment of a z-bar clip 210 according to the present disclosure. Door attachment portion 220 is generally planar and includes first screw holder mounting hole 225. Z-bar attachment portion 250 is generally planar and includes second screw holder mounting hole 255. These two portions may be removably connected by screws to an inset portion of a door edge of the door and to an inset portion of a front surface of the z-bar, respectively. First connecting portion 230 is generally planar. Where door attachment portion 220 is attached to an inset portion of a door edge, first connecting portion 230 avoids the extended portions of the door edge outside the inset. Second connecting portion 240 may be curved, as shown, or may comprise planar segments. Where z-bar attachment portion 250 is attached to an inset portion of a z-bar, second connecting portion 250 avoids the extended portions of the z-bar outside the inset. In this embodiment, z-bar clip 210 has a consistent cross-section along its length, excepting the screw holder mounting holes.

The z-bar clip may be made of any suitable material. In some embodiments, the z-bar is a unitary construction comprising a single piece of material. In some embodiments, the z-bar material is an extruded material. In some embodiments, the z-bar material is a polymeric material. In some embodiments, the z-bar material is a thermoplastic material. In some embodiments, the z-bar material is a moldable material. In some such embodiments, the z-bar is a unitary construction made in a single molding. In this embodiment the screw holder mounting screws may be added in a secondary step after the z-bar is made.

Live Bolt Retainer

Figure 13A:
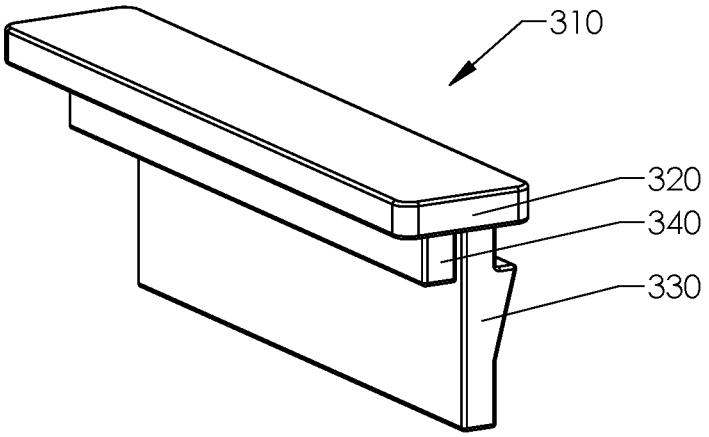
FIGS. 13*a* and 13*b* are views of one embodiment of a live bolt retainer of the disclosed door system.
Figure 13B:
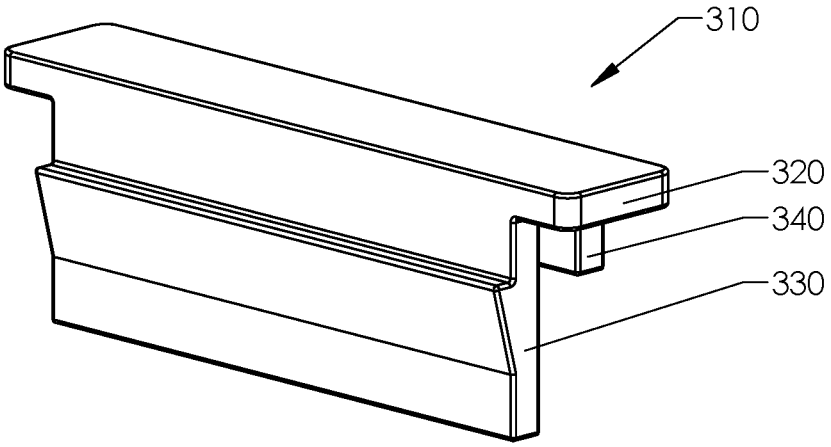

FIGS. 13*a* & 13*b* depict one embodiment of a live bolt retainer 310 according to the present disclosure. Bolt retaining portion 320 is generally planar. Clip portion 330 is adapted to engage and hold edges of a bolt hole in the edge of a door. Optional extension 340 may additionally engage edges of a bolt hole and/or the end of the bolt itself. Live bolt retainer 310 retains in a retracted position a live bolt, which emerges from a bolt hole in the edge of a door, during shipping and installation. Typically it is removed and discarded after installation of door handles, knobs, or other mechanisms used to retract the live bolt.

The live bolt retainer 310 may be made of any suitable material. In some embodiments, the live bolt retainer 310 is a unitary construction comprising a single piece of material. In some embodiments, the live bolt retainer material is a polymeric material. In some embodiments, the live bolt retainer material is a thermoplastic material. In some embodiments, the live bolt retainer material is a moldable material. In some such embodiments, the live bolt retainer 310 is a unitary construction made in a single molding.

Additional embodiments are recited in the Selected Embodiments and Examples below.

Selected Embodiments

The following embodiments, designated by letter and number, are intended to further illustrate the present disclosure but should not be construed to unduly limit this disclosure.

SH1. A screw holder adapted to hold a screw in a stable position relative to a screw holder mounting hole in a first substrate, prior to driving the screw to attach the first substrate to a second substrate, comprising:

a) a screw holder body having a screw-point end, pointing in a screw-point direction, and a screw-head end, pointing in a screw-head direction, having a hollow interior open at the screw-head end for receiving a screw into the hollow interior, wherein the screw holder body has an outer perimeter adapted to fit into the hole in the first substrate;

b) a collar portion at the screw-point end of the screw holder body adapted to prevent the screw holder from passing entirely through the hole in the screw-head direction;

c) one or more locking extensions extending from the screw holder body, which are compressible against or into the screw holder body to allow the screw holder to be inserted into the screw holder mounting hole in the screw-head direction and which rebound after insertion to prevent the screw holder from passing out of the screw holder mounting hole in the screw-point direction.

SH2. The screw holder according to any of the preceding embodiments wherein the hollow interior of the screw holder body is also open at the screw-point end of the screw holder body.

SH3. The screw holder according to any of the preceding embodiments additionally comprising an orienting projection on the side of the collar portion that faces the screw-head end of the screw holder body.

SH4. The screw holder according to any of the preceding embodiments comprising a polymeric material.

SH5. The screw holder according to any of the preceding embodiments comprising a moldable material, where the screw holder is a unitary construction made in a single molding.

SH6. The screw holder according to any of the preceding embodiments which is a unitary construction comprising a single piece of material.

SH7. The screw holder according to any of the preceding embodiments wherein the one or more locking extensions are adapted to splay out flat against a first substrate when the screw holder is mounted in a screw holder mounting hole in the first substrate and a screw is fully driven into the screw holder.

SH8. The screw holder according to any of the preceding embodiments wherein the screw holder body comprises wall segments adapted to fold outward when the screw holder is mounted in a screw holder mounting hole in the first substrate and a screw is fully driven into the screw holder.

SH9. The screw holder according to any of the preceding embodiments additionally comprising break lines comprising furrows and/or perforations running lengthwise from the screw-head end of the screw holder body toward the screw-point end of the screw holder body, the break lines being adapted to break when the screw holder is mounted in a screw holder mounting hole in the first substrate and a screw is fully driven into the screw holder.

SHA1. An assembly comprising a first substrate comprising a screw holder mounting hole, a screw holder according to any of the preceding embodiments mounted in the screw holder mounting hole, and a screw driven into the screw holder at the screw-head end so as to extend not more than 5.0 mm beyond the screw-point end of the screw holder.

SHA2. The assembly according to embodiment SHA1 wherein the screw is driven into the screw holder at the screw-head end so as to extend not more than 1.0 mm beyond the screw-point end of the screw holder.

SHA3. The assembly according to embodiment SHA1 wherein the screw is driven into the screw holder at the screw-head end so as to not extend beyond the screw-point end of the screw holder.

SHA4. The assembly according to any of embodiments SHA1-SHA3 wherein the first substrate comprises a material selected from metals, plastics, fiber/resin composites, glass, ceramic or stone.

SHA5. The assembly according to any of embodiments SHA1-SHA3 wherein the first substrate comprises a material selected from metals.

SHA6. The assembly according to any of embodiments SHA1-SHA5 wherein the screw is a wood screw.

SHA7. The assembly according to any of embodiments SHA1-SHA5 wherein the screw is a sheet metal screw.

SHA8. The assembly according to any of embodiments SHA1-SHA7 wherein the screw holder mounting hole includes a positioning notch and the screw holder additionally comprises an orienting projection on the side of the collar portion that faces the screw-head end of the screw holder body, where the orienting projection is adapted to fit into the positioning notch.

ZC1. A z-bar clip adapted to hold a door in a stable position relative to a latch-side z-bar of a door frame by attachment to the door and to a front surface of the z-bar, comprising:

a) a generally planar door attachment portion comprising a first screw holder mounting hole; connecting to b) a generally planar first connecting portion; connecting to c) a second connecting portion; connecting to d) a generally planar z-bar attachment portion comprising a second screw holder mounting hole;

wherein a) and b) are generally plane-perpendicular to each other;

wherein a) and d) are generally plane-perpendicular to each other;

wherein b) and d) are generally plane-parallel to each other; and wherein the z-bar clip has a consistent cross-section along a length dimension, excepting first and second screw holder mounting holes.

ZC2. The z-bar clip according to embodiment ZC-1 wherein second connecting portion c) is curved.

ZC3. The z-bar clip according to embodiment ZC-1 or ZC-2 wherein the first hole is a keyhole-shaped hole.

ZC4. The z-bar clip according to any of embodiments ZC-1 to ZC-3 comprising a polymeric material.

ZC5. The z-bar clip according to any of embodiments ZC-1 to ZC-4 comprising a moldable material, where the z-bar clip is a unitary construction made in a single molding.

ZC6. The z-bar clip according to any of embodiments ZC-1 to ZC-5 which is an extruded or unitary construction comprising a single piece of material.

ZCA1. An assembly comprising a door mounted in a door frame comprising a latch-side z-bar, wherein the door is held in a stable position relative to the latch-side z-bar by a z-bar clip according to any of embodiments ZC-1 to ZC-6.

ZCA2. An assembly according to embodiment ZCA1 wherein the door attachment portion of the z-bar clip as attached to the door by a screw passing through the first hole.

ZCA3. An assembly according to embodiment ZCA1 or ZCA2 wherein the z-bar attachment portion of the z-bar clip is attached to the z-bar by a screw passing through the second hole.

BR1. A live bolt retainer adapted to retain in a retracted position a live bolt which emerges from a bolt hole in the edge of a door, comprising:

a) a generally planar bolt retaining portion; and b) one or more clip portions adapted to engage and hold edges of a bolt hole in the edge of a door.

BR2. The live bolt retainer according to embodiment BR-1 comprising two clip portions.

BR3. The live bolt retainer according to embodiment BR-1 or BR-2 comprising a polymeric material.

BR4. The live bolt retainer according to any of embodiments BR-1 to BR-3 comprising a moldable material, where the live bolt retainer is a unitary construction made in a single molding.

BR5. The live bolt retainer according to any of embodiments BR1 to BR-4 which is a unitary construction comprising a single piece of material.

DS1. A ready-to-install door system comprising, prior to installation:

a) a door, which is rotatably attached on a hinge-side edge to b) a hinge-side z-bar, which is permanently attached at a top end to c) a drip cap, which is permanently attached to a top end of d) a latch-side z-bar.

DS2. The door system according to embodiment DS1 wherein the door comprises latch hardware comprising at least one bolt capable of securing the door in a closed position after installation.

DS3. The door system according to embodiment DS1 wherein the door comprises latch hardware comprising at least one live bolt capable of securing the door in a closed position after installation.

DS4. The door system according to embodiment DS3 wherein the live bolt is retained in a retracted position by a removable live bolt retainer.

DS5. The door system according to embodiment DS4 wherein the live bolt retainer is the live bolt retainer according to any of embodiments BR1 to BR-5.

DS6. The door system according to any of embodiments DS1-DS5 wherein the door comprises latch hardware comprising a deadbolt and a live bolt.

DS7. The door system according to any of embodiments DS1-DS6 wherein the hinge-side z-bar, drip cap, and latch-side z-bar comprise finished front-facing surfaces.

DS8. The door system according to any of embodiments DS1-DS7 wherein the door comprises door closer hardware contained within the thickness of the door.

DS9. The door system according to embodiment DS8 wherein the door closer hardware comprises a closer arm rotatably attached to a slider which is slideably attached to the drip cap.

DS10. The door system according to any of embodiments DS1-DS9 wherein the door and latch-side z-bar are held in a stable position relative to each other by one or more removable z-bar clips.

DS11. The door system according to embodiment DS11 wherein at least one z-bar clip is the z-bar clip according to any of embodiments ZC1 to ZC-6.

DS12. The door system according to any of embodiments DS1-DS11 comprising the assembly according to any of embodiments ZCA1, ZCA2 and ZCA3.

DS13. The door system according to any of embodiments DS1-DS12 wherein the hinge-side z-bar comprises an installation notch near its top end.

DS14. The door system according to any of embodiments DS1-DS13 wherein one or both z-bars additionally comprise screw holder mounting holes.

DS15. The door system according to embodiment DS14 wherein the screw holder mounting holes include positioning notches.

DS16. The door system according to embodiment DS14 or DS15 wherein at least one screw holder mounting hole has mounted in it a screw holder.

DS17. The door system according to embodiment DS16 wherein at least one screw holder has mounted in it a screw.

DS18. The door system according to any of embodiments DS14-DS17 wherein at least one screw holder is the screw holder according to any of embodiments SH1-SH9.

DS19. The door system according to any of embodiments DS1-DS18 comprising one or more assemblies according to any of embodiments SHA1-SHA8.

DS20. The door system according to any of embodiments DS1-DS19 wherein one or both z-bars additionally comprise z-bar extenders.

DS21. The door system according to any of embodiments DS1-DS20 wherein the door additionally comprises an expander.

DS22. The door system according to any of embodiments DS1-DS21 wherein the door is a residential storm door.

Various modifications and alterations of this disclosure will become apparent to those skilled in the art without departing from the scope and principles of this disclosure, and it should be understood that this disclosure is not to be unduly limited to the illustrative embodiments set forth hereinabove.

What is claimed is:

1. A ready-to-install door system comprising, prior to installation:

a door rotatably attached on a hinge-side edge to a hinge-side z-bar that comprises a top end attached to a drip cap, wherein the drip cap is further attached to a top end of a latch-side z-bar;

wherein at least one of the hinge-side z-bar and the latch-side z-bar comprises at least one preloaded screw, a mounting hole, and at least one screw holder mounted in the mounting hole to hold the at least one preloaded screw.

2. The ready-to-install door system according to claim 1, wherein the system comprises door closer hardware attached to the door and either the drip cap or the hinge-side z-bar.

3. The ready-to-install door system according to claim 2, wherein the door closer hardware is contained within a portion of the door and comprises a closer arm rotatably attached to a slider which is slideably attached to the drip cap or the hinge-side z-bar.

4. The ready-to-install door system according to claim 3, wherein the closer arm is a multi-segment closer arm.

5. The ready-to-install door system according to claim 2, wherein the door closer hardware is contained within a portion of the drip cap and comprises a closer arm rotatably attached to a slider, which is slideably attached to the door.

6. The ready-to-install door system according to claim 5, wherein the closer arm is a multi-segment closer arm.

7. The ready-to-install door system according to claim 1, wherein the door closer is attached to a face of the door and comprises a closer arm pivotably attached to the hinge-side z-bar or drip cap.

8. The ready-to-install door system according to claim 1, wherein the hinge-side z-bar or the latch-side z-bar comprises an installation notch near its top end.

9. The ready-to-install door system according to claim 8, wherein the hinge-side z-bar comprises an installation notch near its top end.

10. The ready-to-install door system according to claim 1, wherein the at least one screw holder is adapted to hold a screw in a stable position relative to a mounting hole in a first substrate, comprising:

a) a screw holder body having a screw-point end, a screw-head end, and a hollow interior open at the screw-head end for receiving a screw, wherein the screw holder body has an outer perimeter adapted to fit into the mounting hole in the first substrate;

b) a collar portion at the screw-point end of the screw holder body adapted to prevent the screw holder from passing entirely through the mounting hole in a screw-head direction; and c) one or more locking extensions extending from the screw holder body, wherein the one or more locking extensions are compressible against or into the screw holder body to allow the screw holder to be inserted into the mounting hole in the screw-head direction and wherein the one or more locking extensions rebound after insertion to prevent the screw holder from passing out of the mounting hole in a screw-point direction.

11. The ready-to-install door system according to claim 10, wherein the mounting hole includes a positioning notch and the screw holder additionally comprises an orienting projection on the side of the collar portion that faces the screw-head end of the screw holder body, where the orienting projection is adapted to fit into the positioning notch.

12. The ready-to-install door system according to of claim 1, wherein the door and latch-side z-bar are held in a stable position relative to each other by one or more removable z-bar clips.

13. The ready-to-install door system according to claim 12, wherein at least one z-bar clip comprises:

a) a generally planar door attachment portion comprising a first screw hole; connecting to b) a generally planar first connecting portion; connecting to c) a second connecting portion; connecting to d) a generally planar z-bar attachment portion comprising a second screw hole;

wherein a) and b) are generally plane-perpendicular to each other;

wherein a) and d) are generally plane-perpendicular to each other;

wherein b) and d) are generally plane-parallel to each other; and wherein the z-bar clip has a consistent cross-section along a length dimension, excepting first and second screw holes.

14. The ready-to-install door system according to claim 1, wherein the door comprises latch hardware comprising at least one live bolt capable of securing the door in a closed position after installation, and wherein the live bolt is retained in a retracted position by a removable live bolt retainer.

15. A screw holder adapted to hold a screw in a stable position relative to a mounting hole in a first substrate, prior to driving the screw to attach the first substrate to a second substrate, comprising:

a) a screw holder body having a screw-point end, a screw-head end, and a hollow interior open at the screw-head end for receiving a screw, wherein the screw holder body has an outer perimeter adapted to fit into the mounting hole in the first substrate;

b) a collar portion at the screw-point end of the screw holder body adapted to prevent the screw holder from passing entirely through the mounting hole in a screw-head direction; and c) one or more locking extensions extending from the screw holder body, wherein the one or more locking extensions are compressible against or into the screw holder body to allow the screw holder to be inserted into the mounting hole in the screw-head direction, and wherein the one or more locking extensions rebound after insertion to prevent the screw holder from passing out of the mounting hole in a screw-point direction.

16. The screw holder according to claim 15, wherein the screw holder body comprises wall segments adapted to fold outward when the screw holder is mounted in the mounting hole and a screw is fully driven into the screw holder.

17. A method of installing a ready-to-install door system comprising the steps of:

a) providing a ready-to-install door system comprising:
a door rotatably attached on a hinge-side edge to a hinge-side z-bar that comprises a top end attached to a drip cap, wherein the drip cap is further attached to a top end of a latch-side z-bar;
wherein at least one of the hinge-side z-bar and the latch-side z-bar comprises at least one preloaded screw, a mounting hole, and at least one screw holder mounted in the mounting hole to hold the at least one preloaded screw;
b) positioning the ready-to-install door system within or adjacent to a frame of a door opening; and
c) attaching the ready-to-install door system to the frame of the door opening with the at least one preloaded screw.

18. The method according to claim 17, wherein at least one of the screws is driven into the frame of a door opening at a predetermined distance from the top of the door opening and the ready-to-install door system hangs from the screw by an installation notch on the hinge-side z-bar.

19. The method according to claim 17, wherein the attaching the ready-to-install door system to the frame of the door opening is performed by fully driving the at least one screw mounted in the at least one screw holder.

20. The method according to claim 17, wherein the system comprises door closer hardware attached to the door and either the drip cap or the hinge-side z-bar, and wherein the door closer hardware is attached to the door and comprises a closer arm rotatably attached to a slider, which is slideably attached to the drip cap or the hinge-side z-bar.

21. The method according to claim 20, wherein the closer arm is a multi-segment closer arm.

22. The method according to claim 17, wherein the system comprises door closer hardware attached to the door and the drip cap, and wherein the door closer hardware comprises a closer arm rotatably attached to a slider, which is slideably attached to the door.

* * * * *